US010851593B2

(12) United States Patent
Nakamura et al.

(10) Patent No.: US 10,851,593 B2
(45) Date of Patent: Dec. 1, 2020

(54) DRILLING TOOL

(71) Applicant: MITSUBISHI MATERIALS CORPORATION, Tokyo (JP)

(72) Inventors: Kazuyoshi Nakamura, Anpachi-gun (JP); Yasutaka Tomita, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 16/323,855

(22) PCT Filed: Aug. 9, 2017

(86) PCT No.: PCT/JP2017/028924
§ 371 (c)(1),
(2) Date: Feb. 7, 2019

(87) PCT Pub. No.: WO2018/030464
PCT Pub. Date: Feb. 15, 2018

(65) Prior Publication Data

US 2019/0169938 A1 Jun. 6, 2019

(30) Foreign Application Priority Data

Aug. 9, 2016 (JP) ..... 2016-156431

(51) Int. Cl.
*E21B 10/40* (2006.01)
*E21B 10/627* (2006.01)
(Continued)

(52) U.S. Cl.
CPC ..... *E21B 10/40* (2013.01); *E21B 1/02* (2013.01); *E21B 10/36* (2013.01); *E21B 10/43* (2013.01); *E21B 10/627* (2013.01)

(58) Field of Classification Search
CPC ..... E21B 10/40
See application file for complete search history.

(56) References Cited

U.S. PATENT DOCUMENTS

2014/0311807 A1 10/2014 Beierer et al.
2019/0003261 A1 1/2019 Tanaka et al.

FOREIGN PATENT DOCUMENTS

CA 2942534 A1 10/2015
EP 1837481 A1 9/2007
(Continued)

OTHER PUBLICATIONS

International Search Report dated Nov. 7, 2017, issued for PCT/JP2017/028924 and English translation thereof.
(Continued)

*Primary Examiner* — Kristyn A Hall
*Assistant Examiner* — Dany E Akakpo
(74) *Attorney, Agent, or Firm* — Locke Lord LLP

(57) ABSTRACT

A drilling tool has: a casing pipe in a circular tubular shape; a cylindrical or annular ring bit rotatably fitted to a tip portion of the casing pipe; and a pilot bit inserted into an inner circumference of the ring bit for a striking force to be exerted to toward a tip end side, wherein the ring bit is engaged with and fitted to the casing pipe, projections are formed on an outer circumferential portion of the pilot bit, a recessed trench, and a housing trench, are formed in the inner circumferential part of the ring bit, a torque transmitting surface is formed in the projection, a torque receiving surface capable of abutting the torque transmitting surface is formed in the housing trench, striking force transmitting surfaces are formed in projections, and striking force receiving surfaces capable of abutting the striking force transmitting surfaces are formed in the ring bit.

4 Claims, 7 Drawing Sheets

(51) Int. Cl.

| | |
|---|---|
| ***E21B 10/36*** | (2006.01) |
| ***E21B 1/02*** | (2006.01) |
| ***E21B 10/43*** | (2006.01) |

(56) References Cited

FOREIGN PATENT DOCUMENTS

| | | | | |
|---|---|---|---|---|
| EP | 2339109 | A2 | 6/2011 | |
| EP | 2975209 | A1 | 1/2016 | |
| GB | 2465653 | A | 6/2010 | |
| JP | 2010-121275 | A | 6/2010 | |
| JP | 2011-021411 | A | 2/2011 | |
| JP | 2012-031610 | A | 2/2012 | |
| JP | 2012-154096 | A | 8/2012 | |
| JP | 5402397 | B2 | 1/2014 | |
| WO | 98/13575 | A1 | 4/1998 | |
| WO | WO-2010071563 | A1 * | 6/2010 | ..... E21B 10/40 |
| WO | 2017126247 | A | 7/2017 | |

OTHER PUBLICATIONS

Extended European Search Report for Appln No. 17839531.5-1002/3498967 PCT/JP2017028924 dated Feb. 19, 2020.
European Office Action dated Oct. 13, 2020 for Application No. 17839531.5, 7 pages.

* cited by examiner

DRILLING TOOL

TECHNICAL FIELD

The present invention relates to a so-called double pipe type drilling tool that performs drilling by a ring bit disposed on a tip end side of a casing pipe and a pilot bit inserted in the casing pipe.

Priority is claimed on Japanese Patent Application No. 2016-156431, filed on Aug. 9, 2016, the content of which is incorporated herein by reference.

BACKGROUND ART

As such a drilling tool, a drilling tool including a circular tubular casing pipe, a cylindrical casing top bonded to a tip portion of the casing pipe, an inner bit (pilot bit) that is coaxially fitted to the tip portion of the casing top so as to be rotatable about an axis of the casing top and is inserted in the casing pipe, and an annular ring bit that can be engaged with the pilot bit on a tip end side in an axial direction about the axis is disclosed in, for example, Patent Document 1.

CITATION LIST

Patent Literature

[Patent Document 1] Japanese Patent (Granted) Publication No. 5402397

SUMMARY OF INVENTION

Technical Problem

In the drilling tool disclosed in Patent Document 1, a projection of the pilot bit, of which an outer diameter temporarily increases, is formed on a posterior end side of a tip portion of the pilot bit, which is to be inserted into an inner circumferential part of the ring bit. By the projection abutting a posterior end portion of the ring bit projecting to an inner circumferential side of the casing pipe, the ring bit engages with the pilot bit on the tip end side in the axial direction, and a striking force from a down-the-hole hammer fitted to a posterior end portion of the pilot bit is transmitted.

However, since there is one striking force transmitting surface of the pilot bit, which faces the tip end side in the axial direction and transmits a striking force toward the tip end side in the axial direction, and there is one striking force receiving surface of the ring bit, which faces the posterior end side in the axial direction, abuts the striking force transmitting surface, and receives the striking force, in the axial direction in the drilling tool disclosed in Patent Document 1, there is a possibility that the striking force exerted to the pilot bit concentrates on one striking force transmitting surface and one striking force receiving surface and wear is caused at an early stage. In addition, when a strong striking force is exerted to the pilot bit, there is a possibility that sufficiently transmitting the striking force becomes difficult since a large total abutting area of the pilot bit and the ring bit cannot be secured.

The present invention is devised under such circumstances, and an object thereof is to provide a drilling tool that can prevent the concentration of a striking force to suppress early wear of a pilot bit and a ring bit and can reliably transmit a striking force to the ring bit even when a large striking force is exerted to the pilot bit.

Solution to Problem

According to an aspect of the present invention, in order to solve the problem, there is provided a drilling tool including: a casing pipe having a circular tubular shape about an axis; a cylindrical or annular ring bit which is rotatably fitted to a tip portion of the casing pipe; and a pilot bit which is inserted into an inner circumferential part of the ring bit and configured for a striking force to be exerted to toward a tip end side of an axial direction while being rotated about the axis, wherein the ring bit is engaged with and fitted to the casing pipe on the tip end side in the axial direction, a plurality of projections are formed along the axial direction on an outer circumferential portion of the pilot bit with an interval therebetween, a recessed trench, which is configured for one of the projections to be inserted from a posterior end side in the axial direction and extends in the axial direction, and a housing trench, which extends from the recessed trench in a rotation direction of the pilot bit in drilling and is configured to house at least one of the projections, are formed in the inner circumferential part of the ring bit, a torque transmitting surface, which is configured to face the rotation direction, is formed in the at least one of the projections, a torque receiving surface, which is configured to face an opposite side to the rotation direction and is capable of abutting the torque transmitting surface, is formed in the housing trench, striking force transmitting surfaces, which are configured to face the tip end side in the axial direction, are formed in two or more of the plurality of projections in the axial direction with an interval therebetween, and two or more striking force receiving surfaces, which are configured to face the posterior end side in the axial direction and are capable of abutting the striking force transmitting surfaces respectively, are formed in the ring bit with an interval equal to the interval of the striking force transmitting surfaces in the axial direction.

In the drilling tool configured in such a manner, two or more, that is, the plurality of striking force transmitting surfaces and the plurality of striking force receiving surfaces are formed in the pilot bit and the ring bit respectively at an equal distance in the axial direction. Therefore, the striking force transmitting surfaces simultaneously abut the striking force receiving surfaces. For this reason, a striking force to be transmitted from the pilot bit to the ring bit can be distributed and transmitted to the plurality of striking force transmitting surfaces and the plurality of striking force receiving surfaces. The wear of the individual striking force transmitting surfaces and the individual striking force receiving surfaces can be suppressed, and thus the life of the ring bit and the life of the pilot bit can be extended. In addition, even when a strong striking force is exerted to the pilot bit, the striking force can be efficiently transmitted to the ring bit since a large total abutting area of the ring bit and the pilot bit can be secured.

In a case where the striking force transmitting surfaces and the striking force receiving surfaces are formed so as to be inclined to the posterior end side in the axial direction as it goes to the outer circumferential side with respect to the axis, an even larger total abutting area of the striking force transmitting surfaces and the striking force receiving surfaces can be secured, and it is possible to more reliably distribute and transmit a striking force. Wear can be more reliably suppressed, and a more efficient striking force transmission can be achieved.

In two projections, which are adjacent to each other in the axial direction, out of the plurality of projections, the length of a projection, which is on the tip end side in the axial direction, in the circumferential direction is smaller than the length of a projection, which is on the posterior end side in the axial direction, in the circumferential direction. Accordingly, the length of the recessed trench, which is a portion where the projection on the tip end side is inserted, in the circumferential direction is smaller than the length of the recessed trench, which is a portion where the projection on the posterior end side is inserted, in the circumferential direction. In this manner, the pilot bit may be prevented from coming off to the tip end side in the axial direction. In this case, in a case where the at least one projection is housed in the housing trench in drilling and the recessed trench is clogged with sediment, the pilot bit can be prevented from falling into a borehole even when the pilot bit is rotated in the opposite side to the rotation direction in drilling and the sediment is discharged.

Advantageous Effects of Invention

As described above, according to the present invention, life extension can be achieved by suppressing the wear of the pilot bit and the ring bit, and it is possible to cause efficient transmission of a striking force.

DESCRIPTION OF EMBODIMENTS

Figure 1:
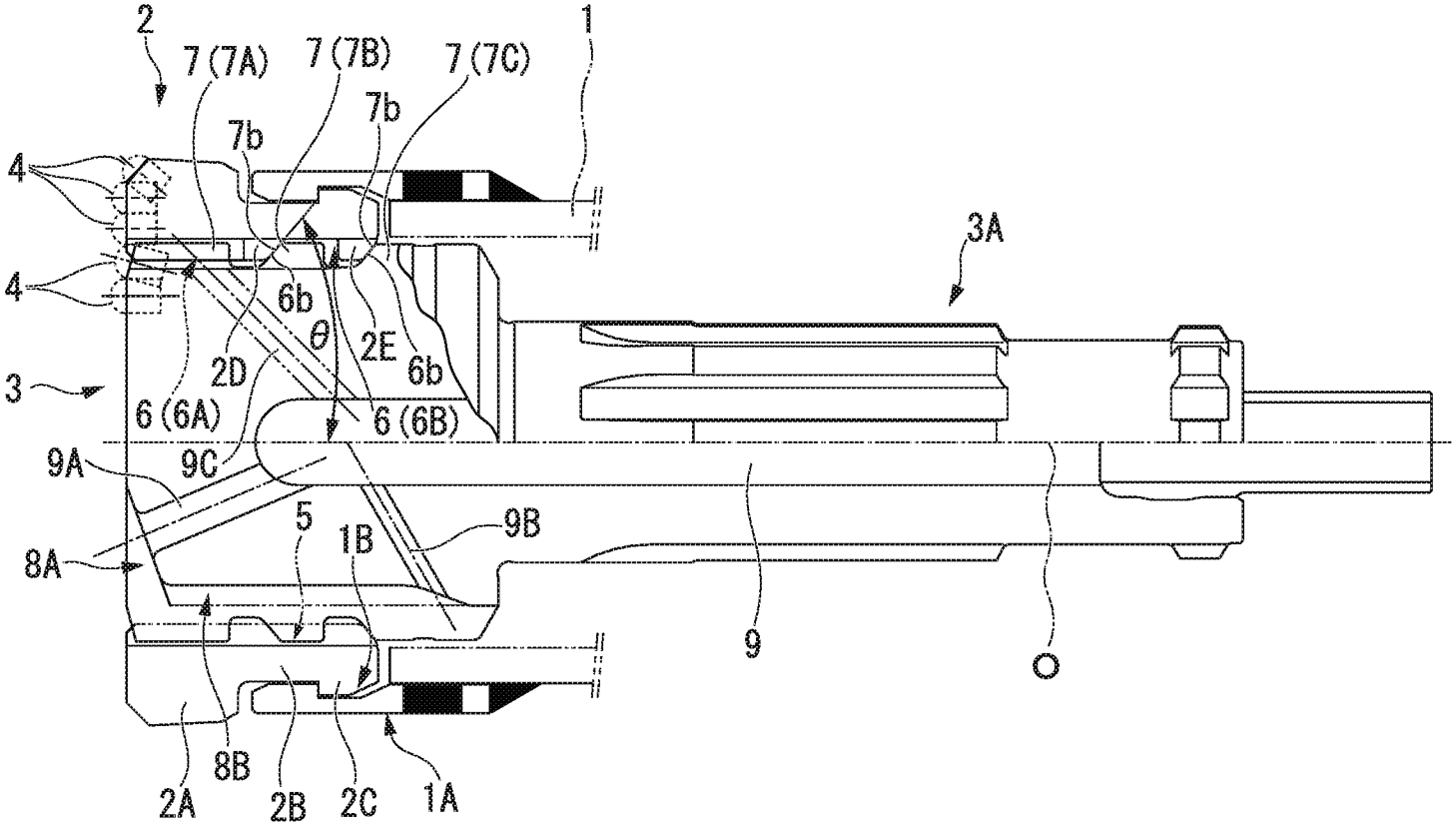
FIG. 1 is a side sectional view showing an embodiment of a drilling tool of the invention.

FIGS. 1 to 9 show an embodiment of the present invention. In the embodiment, a casing pipe 1 is formed of a metal material, such as steel, in a circular tubular shape about an axis O. The casing pipe 1 is coaxially and sequentially added on a posterior end side in the axis O direction (the right in FIG. 1) if necessary and is inserted into a borehole. A tip portion of a casing top 1A protrudes from a tip of the casing pipe 1 to a tip end side in the axis O direction and is coaxially fixed to a tip portion of the casing pipe 1, which is on the most distal end.

The casing top 1A of the embodiment is formed of a metal material, such as steel, in a cylindrical shape about the axis O. An inner diameter and an outer diameter thereof are larger than the inner diameter and the outer diameter of the casing pipe 1. In a state where an inner periphery of a posterior end portion thereof is fitted to an outer periphery of the tip portion of the casing pipe 1, which is on the most distal end, the inner periphery of the posterior end portion is bonded to the casing pipe 1 by welding or the like. In an inner circumferential part of the casing top 1A protruding from the tip of the casing pipe 1, an annular engagement trench 1B is formed around the axis O. A trench wall of the engagement trench 1B, which faces the posterior end side in the axis O direction, is perpendicular to the axis O, and a trench wall facing the tip end side is inclined so to the tip end side as it goes to an outer circumferential side.

A cylindrical or annular ring bit 2 is coaxially fitted to the tip portion of the casing top 1A so as to be rotatable about the axis O with respect to the casing top 1A and to be engaged on the tip end side and the posterior end side in the axis O direction such that the ring bit 2 does not come off.

A transmitting member (not shown) such as a rod is sequentially added if necessary and is coaxially inserted into an inner periphery of the casing pipe 1. The transmitting member on the most posterior end is connected to a drilling device that exerts torque about the axis O in a rotation direction T in drilling and an impelling force toward the tip end side in the axis O direction if necessary. A pilot bit 3 is fitted to a tip portion of the transmitting member, which is on the most distal end, via a hammer (not shown) exerting a striking force toward the tip end side in the axis O direction, such as a down-the-hole hammer, and a tip portion of the pilot bit 3 is coaxially inserted into an inner circumferential part of the ring bit 2.

A main body of the ring bit 2 is formed of a metal material such as steel. The main body is formed such that an outer diameter thereof is the largest at a tip portion 2A, and the diameter temporarily decreases at a middle portion 2B, which is on the posterior end side of the tip portion 2A, and then the diameter temporarily increases at a posterior end portion 2C, which is on the posterior end side of the middle portion 2B. The outer diameter of the posterior end portion 2C is smaller than the outer diameter of the tip portion 2A. The posterior end portion 2C of the ring bit 2 has an outer diameter that is slightly smaller than the inner diameter of the engagement trench 1B of the casing top 1A, and has a length in the axis O direction that is also slightly smaller than that of the engagement trench 1B. The outer diameter of the middle portion 2B is slightly smaller than the inner diameter of the casing top 1A on the tip end side of the engagement trench 1B, and the length of the middle portion 2B in the axis O direction is slightly larger than the length of a portion on the tip end side of the engagement trench 1B of the casing top 1A.

As shown in FIG. 1, the ring bit 2 is made such that the posterior end portion 2C can be housed in the engagement trench 1B. In this state, as described above, the ring bit 2 is engaged so as to be rotatable about the axis O with respect to the casing top 1A and to be immovable to the tip end side and the posterior end side in the axis O direction. In order to house the posterior end portion 2C in the engagement trench 1B and then to fit the ring bit 2 to the casing top 1A, for example, as in the drilling tool disclosed in Patent Document 1, the casing top 1A is formed in a C-shape in a cross-section orthogonal to the axis O, and the posterior end portion 2C of the ring bit 2 is pushed in from the tip end side of the casing top 1A by press fitting or the like. After the casing top 1A is elastically deformed to house the posterior end portion 2C in the engagement trench 1B, one butting portion of the casing top 1A in a circumferential direction is bonded. Alternatively, the casing top 1A may be formed in a shape cut in half in the circumferential direction. After the posterior end portion 2C of the ring bit 2 is housed in the engagement trench 1B, two butting portions of the casing top 1A in the circumferential direction may be bonded.

A wall surface of the posterior end portion 2C of the ring bit 2, which faces the tip end side in the axis O direction, is perpendicular to the axis O, and a wall surface facing the posterior end side is inclined to the tip end side as it goes to the outer circumferential side at the same angle as the trench wall of the engagement trench 1B, which faces the tip end side. The largest outer diameter of the tip portion 2A of the ring bit 2 is larger than the outer diameter of the casing top 1A, and an outer circumferential surface of the tip portion 2A increases as it goes to the tip end side in the axis O direction.

An outer circumferential portion of a tip surface of the ring bit 2 is set as a truncated conical surface-shaped gauge surface inclined to the posterior end side as it goes to the outer circumferential side. A portion which is on an inner circumferential side of the gauge surface and around the inner circumferential part of the ring bit 2 is set as a face surface perpendicular to the axis O. A posterior end portion of a cylindrical drilling tip 4 made of a hard material having hardness higher than that of the main body of the ring bit 2, such as cemented carbide, is buried in the gauge surface and the face surface, and a hemispherical tip portion of the drilling tip 4 perpendicularly protrudes from each of the gauge surface and the face surface.

Figure 7:
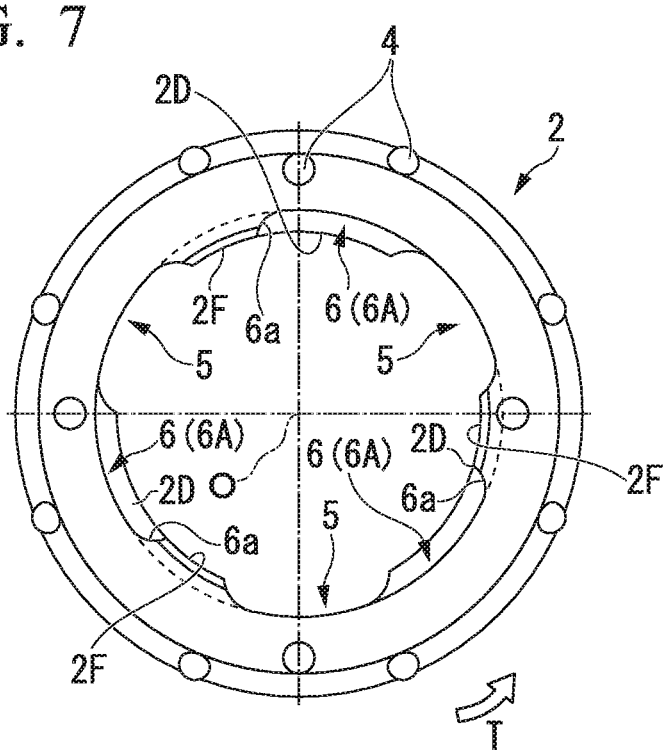
FIG. 7 is a front view of the ring bit in the embodiment shown in FIG. 1.
Figure 8:
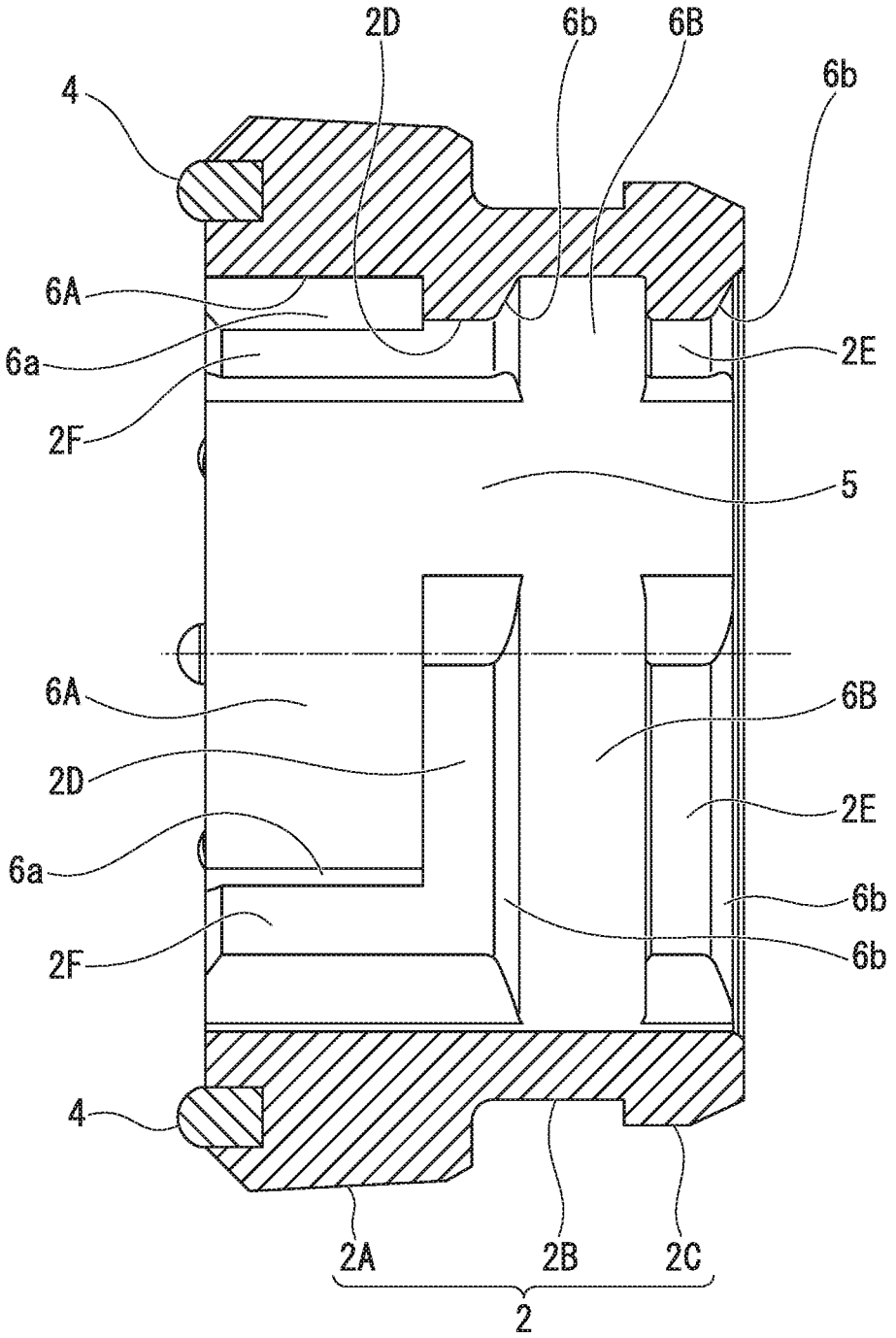
FIG. 8 is a side sectional view of the ring bit in the embodiment shown in FIG. 1.
Figure 9:
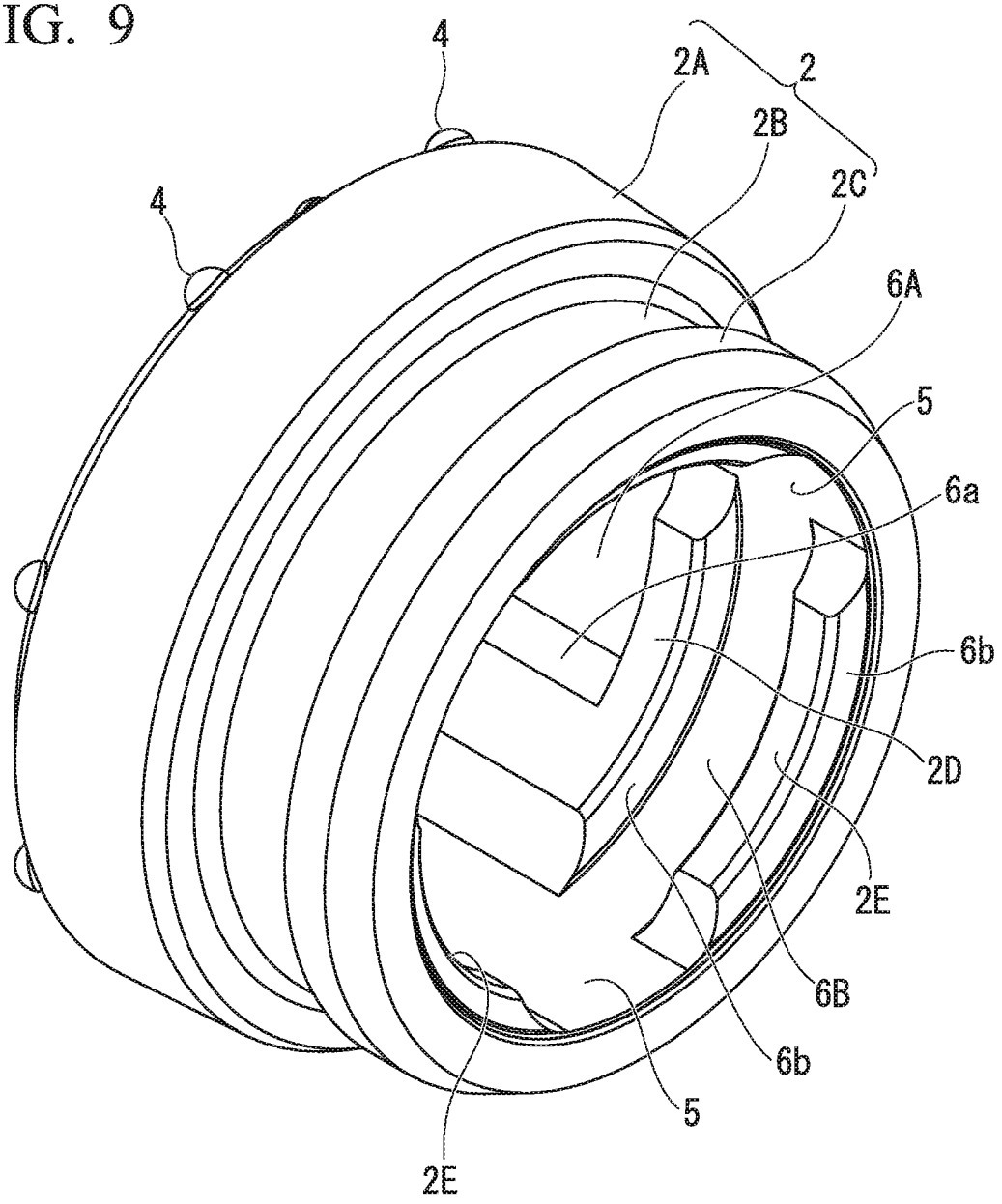
FIG. 9 is a perspective view of the ring bit seen from behind in the embodiment shown in FIG. 1.

The inner diameter (the smallest inner diameter) of the ring bit 2 is smaller than the inner diameter of the casing pipe 1. As shown in FIGS. 7 and 8, a plurality of recessed trenches 5 extending from a posterior end to the tip end side in the axis O direction and at least one housing trench 6 extending from each of the recessed trenches 5 in the rotation direction T are formed in the inner circumferential part of the ring bit 2. Although there are three recessed trenches 5 in the embodiment, it is possible to have one, two, or four or more recessed trenches 5 in the present invention. In addition, although the recessed trenches 5 are open to the tip surface of the ring bit 2 in the embodiment, a configuration where the recessed trenches 5 are not open to the tip surface of the ring bit 2 is also possible in the present invention. The housing trench 6 of the embodiment has a first housing trench 6A open to the tip surface of the ring bit 2 and a second housing trench 6B formed at a fixed distance from a posterior end of the first housing trench 6A and at a fixed distance from the posterior end surface of the ring bit 2 as well.

The depths of the recessed trenches 5 and the housing trench 6 (the first housing trench 6A and the second housing trench 6B) are the same, and the radiuses of the recessed trenches 5 and the housing trench 6 from the axis O to trench bottom surfaces are substantially the same as the radius of an inner circumferential surface of the casing pipe 1 from the axis O. In the embodiment, the three recessed trenches 5 are formed at equal distances in the circumferential direction, that is, at a pitch of 120°. The first housing trench 6A on the tip end side is formed in an arc shape as shown in FIG. 7 when seen from the tip end side in the axis O direction so as to extend from the recessed trench 5 in the rotation direction T and not to reach another recessed trench 5 which is adjacent in the rotation direction T. A third projecting portion 2F, which extends in the axis O direction and has a fixed width, is formed between the first housing trench 6A and another recessed trench 5 described above, and a posterior end of the third projecting portion 2F is connected to one end of a first projecting portion 2D at a right angle. On the other hand, the second housing trench 6B on the posterior end side is formed in an annular shape around the inner circumferential part of the ring bit 2. The second housing trench 6B intersects the recessed trenches 5 at three places at every 120°, and there is no step at intersecting portions.

In the embodiment, a trench wall of the first housing trench 6A, which faces an opposite side to the rotation direction T, is set as a torque receiving surface 6*a*. That is, a wall surface of the third projecting portion 2F, which faces the opposite side to the rotation direction T, is set as the torque receiving surface 6*a*. The first projecting portion 2D and a second projecting portion 2E, which extend in the circumferential direction and have a fixed width, are formed in the inner circumferential part of the ring bit 2. The first projecting portion 2D is formed between the first housing trench 6A and the second housing trench 6B except for a portion where the recessed trench 5 is formed. The second projecting portion 2E is formed between the second housing trench 6B and a posterior end surface of the inner circumferential part of the ring bit 2 except for the portion where the recessed trench 5 is formed. Wall surfaces of the first projecting portion 2D and the second projecting portion 2E, which face the posterior end side in the axis O direction, that is, a trench wall of the second housing trench 6B, which faces the posterior end side in the axis O direction, and the posterior end surface of the inner circumferential part of the ring bit 2 are set as two or more (two) striking force receiving surfaces 6*b* in the embodiment.

Figure 6:
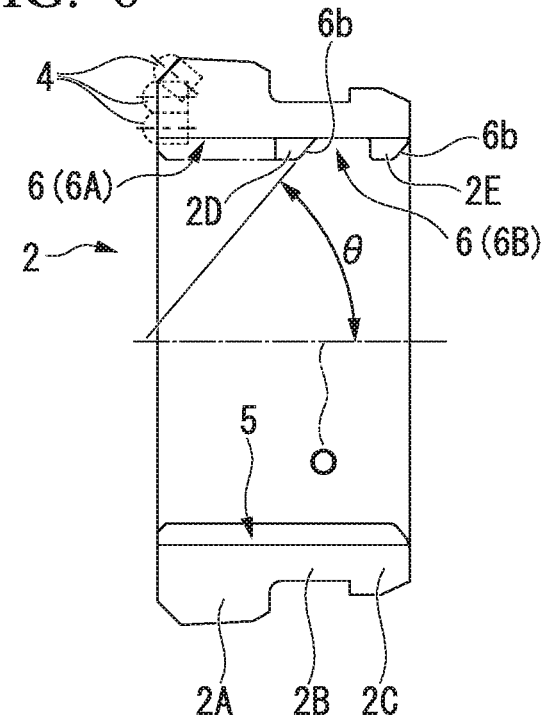
FIG. 6 is a side sectional view of the ring bit in the embodiment shown in FIG. 1.

As shown in FIG. 6, the striking force receiving surfaces 6*b* are formed so as to be inclined to the posterior end side in the axis O direction as it goes to the outer circumferential side. Inclination angles θ thereof with respect to the axis O are the same, and are, for example, within a range of 40° to 80°. On the contrary, trench walls of the first housing trench 6A and the second housing trench 6B, which face the tip end side in the axis O direction, are perpendicular to the axis O, and accordingly, the first projecting portion 2D and the second projecting portion 2E are formed in a trapezoidal shape having an oblique side on the posterior end side in the axis O direction in a cross-section along the axis O. The torque receiving surfaces 6*a* and trench walls of the recessed trenches 5, which face the opposite side of the rotation direction T, are formed in a recessed curved face shape facing the inner circumferential side of the ring bit 2 as it goes to the rotation direction T when seen from the tip end side in the axis O direction. The trench walls of the recessed trenches 5, which face the rotation direction T, are formed in a recessed curved face facing the inner circumferential side as it goes to the opposite side to the rotation direction T.

At the first projecting portion 2D between the first housing trench 6A and the second housing trench 6B and the second projecting portion 2E between the second housing trench 6B and the posterior end surface of the inner circumferential part of the ring bit 2, the positions of the wall surfaces of the recessed trenches 5, which face the rotation direction T, in the circumferential direction are the same. On the other hand, the positions of the wall surfaces, which face the opposite side to the rotation direction T, in the circumferential direction is provided such that the second projecting portion 2E are positioned on a rotation direction T side than the first projecting portion 2D is. Also the positions of the trench walls, which face the opposite side to the rotation direction T, in the circumferential direction are also the same in the embodiment. Therefore, the groove width of the recessed trench 5 formed between the adjacent second projecting portions 2E is the same as the groove width of the recessed trench 5 formed between the adjacent first projecting portions 2D. However, in the present invention, the recessed trenches 5 may be formed such that the second projecting portions 2E are positioned on the rotation direction T side than the first projecting portion 2D are. In this case, the groove width of the recessed trench 5 formed between the adjacent second projecting portions 2E is larger than the groove width of the recessed trench 5 formed between the adjacent first projecting portions 2D.

Figure 4:
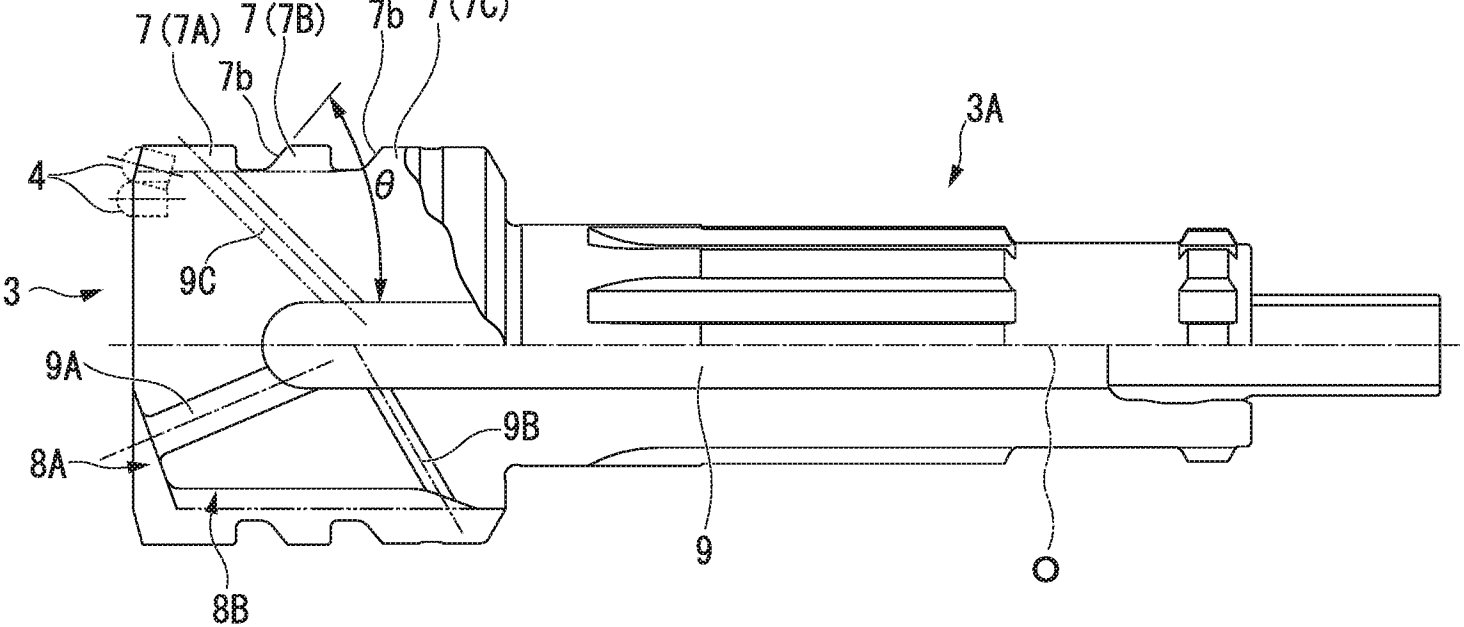
FIG. 4 is a side sectional view of the pilot bit in the embodiment shown in FIG. 1.

The pilot bit 3 is formed of a metal material, such as steel, in a multi-stage columnar shape about the axis O, of which a tip portion has a temporarily large diameter compared to a posterior end portion as shown in FIGS. 1 and 4. The tip portion is disposed coaxially with the axis O in a state of being inserted in the inner circumferential part of the ring bit 2 as shown in FIG. 1. The posterior end portion of the pilot bit 3, which has a small diameter, is a shank portion 3A connected to the hammer, and the hammer and the transmitting member are connected to the shank portion 3A. An interval portion having a cylindrical shape about the axis O is formed between the hammer and the transmitting member and the casing pipe 1, and the interval portion is a discharge path for cuttings such as sediment generated in drilling.

A plurality of projections 7 are formed on an outer periphery of the tip portion of the pilot bit 3 at distances in the axis O direction. In the embodiment, three projections, including first to third projections 7A to 7C provided at distances in the axis O direction in such a manner, are formed at equal distances in the circumferential direction in a plurality of lines, the number of lines being the same (three) as the number of the recessed trenches 5 of the ring bit 2. The first to third projections 7A to 7C are formed such that outer circumferential surfaces thereof are positioned on one cylinder surface about the axis O. The radius of the cylinder surface from the axis O is slightly smaller than a radius from the axis O to the trench bottom surface of the recessed trench 5 or the housing trench 6 of the ring bit 2 and a radius from the axis O to the inner circumferential surface of the casing pipe 1, and is larger than the smallest radius from the axis O to the inner circumferential part of the ring bit 2 (radius from the axis O to an inner circumferential surface of the first projecting portion 2D or the second projecting portion 2E).

Figure 5:
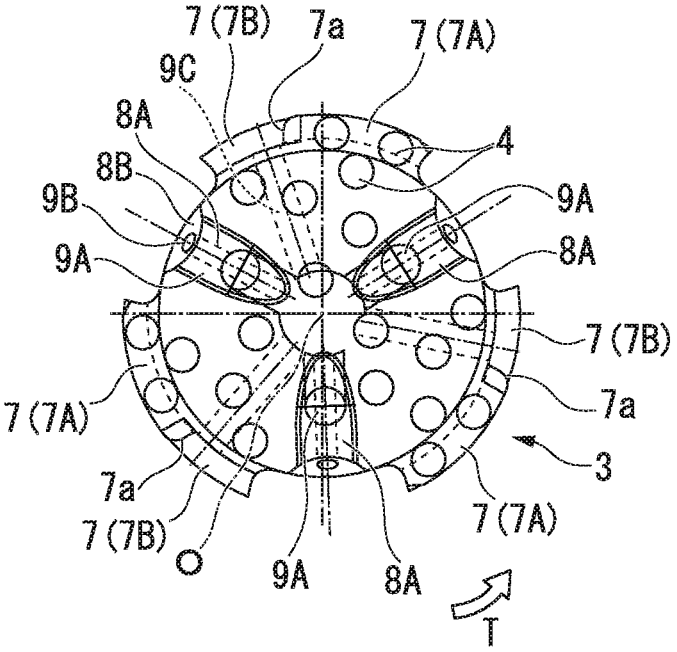
FIG. 5 is a front view of the pilot bit in the embodiment shown in FIG. 1.

A surface of a portion between lines of the first to third projections 7A to 7C, which faces the outer circumferential side, and also a surface of a portion of the first to third projections 7A to 7C in one line along the axis O direction, which faces the outer circumferential side, are formed so as to be positioned on one cylinder surface about the axis O except for a discharge trench to be described later. The radius of the cylinder surface from the axis O is smaller than the smallest radius of the inner circumferential part of the ring bit 2. Therefore, the first to third projections 7A to 7C are formed in an arc shape about the axis O as shown in FIG. 5 when seen from the tip end side in the axis O direction. The first projection 7A on the most distal end reaches a tip surface of the pilot bit 3, and the third projection 7C on the most posterior end reaches a posterior end surface of the tip portion of the pilot bit 3.

Wall surfaces of the first to third projections 7A to 7C in one line, which face the opposite side to the rotation direction T, are disposed at the same position in the circumferential direction. On the contrary, as for wall surfaces of the first to third projections 7A to 7C in one line, which face the rotation direction T side, the wall surface of the second projection 7B in the middle in the axis O direction and the wall surface of the third projection 7C on the most posterior end are at the same position in the circumferential direction. The wall surfaces are positioned on the rotation direction T side of the wall surface of the first projection 7A on the most distal end. The wall surface of the first projection 7A on the most distal end, which faces the rotation direction T, is set as a torque transmitting surface 7*a* abutting the torque receiving surface 6*a* in the embodiment. The torque transmitting surface 7*a* has curvature which is substantially the same as that of the torque receiving surface 6*a* when seen from the tip end side in the axis O direction, and is formed in a curved face shape protruding to an inner circumferential side of the pilot bit 3 as it goes to the rotation direction T.

Figure 2:
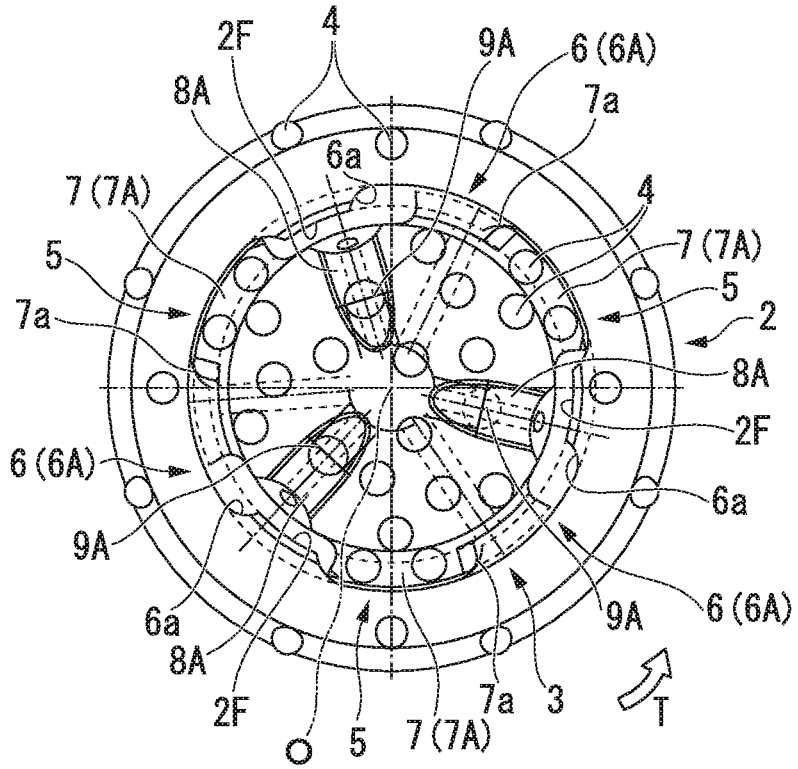
FIG. 2 is a front view showing a state where a projection of a pilot bit is not housed in a housing trench of a ring bit in the embodiment shown in FIG. 1.

Therefore, the length of the first projection 7A in the circumferential direction is smaller than the lengths of the second and third projections 7B and 7C in the circumferential direction as shown in FIG. 5. The first projection 7A is slightly shorter in the circumferential direction than the recessed trench 5 formed in a portion between the adjacent first projecting portions 2D of the ring bit 2 as shown in FIG. 2. On the contrary, the lengths of the second and third projections 7B and 7C in the circumferential direction are larger than the groove width of the recessed trench 5 formed between the second projecting portions 2E of the inner circumferential part of the ring bit 2.

The wall surfaces of the second and third projections 7B and 7C, which face the tip end side in the axis O direction, are formed such that a distance to each other in the axis O direction is equal to a distance between the two striking force receiving surfaces 6*b* of the ring bit 2 in the axis O direction. The wall surfaces of the second and third projections 7B and 7C, which face the tip end side in the axis O direction, are set as two or more (two) striking force transmitting surfaces 7*b* abutting the two or more (two) striking force receiving surfaces 6*b* respectively in the embodiment.

As shown in FIGS. 1 and 4, the two striking force transmitting surfaces 7*b* are inclined to the posterior end side in the axis O direction as it goes to the outer circumferential side with respect to the axis O at the inclination angle θ with respect to the axis O, which is the same as those of the two striking force receiving surfaces 6*b* of the ring bit 2 in the embodiment. "A distance between the two or more striking force transmitting surfaces 7*b* and a distance between the two or more striking force receiving surfaces 6*b* are the same" means that, for example, a distance between the striking force transmitting surfaces 7*b* and a distance between the striking force receiving surfaces 6*b*, which are at positions where radiuses from the axis O are the same and are adjacent to each other in the axis O direction, are equal to each other. The wall surfaces of the first and second projections 7A and 7B, which face the posterior end side in the axis O direction, are perpendicular to the axis O.

In a state where the striking force transmitting surfaces 7*b* of the pilot bit 3 on the tip end side and the posterior end side in the axis O direction abut the striking force receiving surfaces 6*b* of the ring bit 2 on the tip end side and the posterior end side in the axis O direction, a distance is provided between the wall surface of the first projection 7A, which faces the posterior end side in the axis O direction, and the trench wall of the first housing trench 6A, which faces the tip end side in the axis O direction, and a distance is provided between the wall surface of the second projection 7B, which faces the posterior end side in the axis O direction, and the trench wall of the second housing trench 6B, which faces the tip end side in the axis O direction, as shown in FIG. 1. Therefore, the first projection 7A and the second projection 7B can be housed in the first housing trench 6A and the second housing trench 6B respectively.

An outer circumferential portion of the tip surface of the pilot bit 3, which is a portion where the first projection 7A has reached the tip surface, is set as a truncated conical gauge surface inclined to the posterior end side as it goes to the outer circumferential side as in the ring bit 2, and an inner circumferential side of the gauge surface is set as a circular face surface perpendicular to the axis O. The drilling tip 4 made of a hard material having hardness higher than that of the main body of the pilot bit 3, such as cemented carbide, is embedded and fitted so as to perpendicularly protrude from each of the gauge surface and the face surface respectively.

Three ejection trenches 8A, of which depths gradually increase as it goes to the outer circumferential side, are formed in the tip surface of the pilot bit 3 from positions, which are at a distance from the axis O to the outer circumferential side, to portions between the tip portions of the three first projections 7A, respectively. Above-described three discharge trenches 8B, of which tips communicate with outer circumferential ends of the ejection trenches 8A and which extend in parallel with the axis O, are respectively formed in portions between lines of the first to third projections 7A to 7C, which are adjacent to each other in the circumferential direction, in an outer circumferential surface of the tip portion of the pilot bit 3. After extending at a fixed depth toward the posterior end side in the axis O direction, the discharge trenches 8B are cut upwards to the outer circumferential side immediately before a posterior end of the tip portion of the pilot bit 3.

A blow hole 9 for compressed air supplied from the hammer or the like is formed inside the pilot bit 3 from a posterior end of the shank portion 3A toward the tip end side along the axis O. The blow hole 9 branches off to three branch holes including first to third branch holes 9A to 9C at the tip portion of the pilot bit 3. The first branch hole 9A extends to the outer circumferential side as it goes to the tip end side in the axis O direction and is open to the ejection trench 8A. The second branch hole 9B extends to the outer circumferential side as it goes to the tip end side in the axis O direction, and is open to a portion on the rotation direction T side of the first projection 7A in the outer circumferential surface of the tip portion of the pilot bit 3. The third branch hole 9C extends to the outer circumferential side as it goes to the posterior end side in the axis O direction, and is open to a portion where the discharge trench 8B is cut upwards to the outer circumferential side.

In order to manufacture such a drilling tool, first, the posterior end portion 2C of the ring bit 2 is housed in the engagement trench 1B of the casing top 1A as described above, and the casing top 1A is bonded to the tip portion of the casing pipe 1 after the ring bit 2 is engaged so as to be rotatable about the axis O with respect to the casing top 1A and to be immovable to both of the tip end side and the posterior end side in the axis O direction.

Next, the transmitting member and the pilot bit 3 fitted to the tip of the hammer are inserted from the posterior end of the casing pipe 1. The wall surfaces of the first to third projections 7A to 7C, which face the opposite side to the rotation direction T, are aligned with the wall surfaces of the first projecting portion 2D and the second projecting portion 2E of the inner circumferential part of the ring bit 2, which face the rotation direction T, as shown in FIG. 2. Three lines formed of the first to third projections 7A to 7C are inserted into the three recessed trenches 5 respectively while inserting the tip portion of the pilot bit 3 into the ring bit 2.

Since the length of the second projection 7B in the circumferential direction is larger than the length of the recessed trench 5 in the circumferential direction between the adjacent first projecting portions 2D, the striking force transmitting surface 7*b* that is the wall surface of the second projection 7B, which faces the tip end side in the axis O direction, abuts the wall surface of the first projecting portion 2D, which faces the posterior end side in the axis O direction, that is, the striking force receiving surface 6*b* of the second housing trench 6B, which is on the posterior end side in the axis O direction. Thus, the pilot bit 3 cannot be inserted any further.

When the pilot bit 3 is rotated in the rotation direction T in this state, a distance between the striking force transmitting surface 7*b* of the second projection 7B and the striking force receiving surface 6*b* of the second housing trench 6B, which are on the tip end side in the axis O direction, in the axis O direction is equal to a distance between the striking force transmitting surface 7*b* on the posterior end side in the axis O direction that is the wall surface of the third projection 7C, which faces the tip end side in the axis O direction, and the striking force receiving surface 6*b* on the posterior end side in the axis O direction, which is the posterior end surface of the inner circumferential part of the ring bit 2, in the axis O direction. Therefore, also the striking force transmitting surface 7*b* on the posterior end side abuts the striking force receiving surface 6*b* on the posterior end side simultaneously when the striking force transmitting surface 7*b* on the tip end side abuts the striking force receiving surface 6*b* on the tip end side as shown in FIG. 1.

Figure 3:
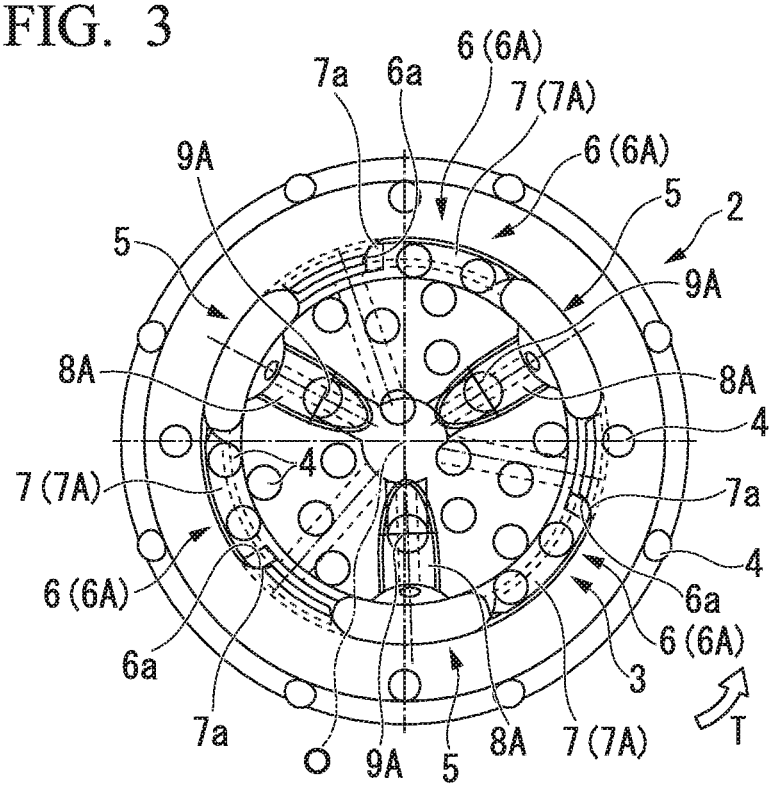
FIG. 3 is a front view showing a state where the projection of the pilot bit is housed in the housing trench of the ring bit in the embodiment shown in FIG. 1.

The pilot bit 3 rotates and the torque transmitting surface 7*a* that is the wall surface of the first projection 7A, which faces the rotation direction T, abuts the torque receiving surface 6*a* that is the trench wall of the first housing trench 6A, which faces the opposite side to the rotation direction T. Accordingly, the ring bit 2 and the pilot bit 3 are integrated in the rotation direction T as shown in FIG. 3. In this state, as shown in FIG. 3, each of the recessed trenches 5 of the ring bit 2 matches each portion of the pilot bit 3 between the second projection 7B and the third projection 7C, which are adjacent to each other in the circumferential direction, and three oval hole portions extending in the circumferential direction are formed.

In the drilling tool configured in such a manner, by pushing the ring bit 2 and the tip surface of the pilot bit 3 against a bedrock to exert torque in the rotation direction T, a striking force on the tip end side in the axis O direction, and if necessary, an impelling force to the pilot bit 3, the torque is transmitted from the torque transmitting surfaces 7*a* to the ring bit 2 via the torque receiving surfaces 6*a*, and the striking force is transmitted from the striking force transmitting surfaces 7*b* to the ring bit 2 via the striking force receiving surfaces 6*b*. Therefore, the drilling tips 4 embedded in the tip surface crush the bedrock to form a borehole while the drilling tool is being inserted into the borehole. In addition, the casing top 1A, to which the ring bit 2 is rotatably is engaged on the tip end side in the axis O direction, and the casing pipe 1 are also inserted into the borehole without rotation.

While performing drilling in such a manner, compressed air or the like is supplied to the blow hole 9 and is ejected from the first to third branch holes 9A to 9C. Cuttings such as sediment generated by the drilling tips 4 in drilling are discharged from the oval hole portions to the posterior end side in the axis O direction via the interval between the hammer and the transmitting member and the casing pipe 1. In addition, when the borehole is formed to a predetermined depth and drilling is terminated, the pilot bit 3 is rotated to the opposite side to the rotation direction T in drilling to return the first to third projections 7A to 7C to the positions of the recessed trenches 5 via the transmitting member and the hammer. Accordingly, the pilot bit 3 can be pulled out from the casing pipe 1 and be collected with the transmitting member and the hammer.

In the drilling tool, two or more, that is, the plurality of striking force transmitting surfaces 7*b* and the plurality of striking force receiving surfaces 6*b* are formed at an equal distance in the axis O direction in the pilot bit 3 and the ring bit 2 respectively. The striking force transmitting surfaces 7*b* abut the striking force receiving surfaces 6*b* simultaneously and a striking force is transmitted as described above. For this reason, the striking force to be transmitted from the pilot bit 3 to the ring bit 2 can be distributed and transmitted to the plurality of striking force transmitting surfaces 7*b* and the plurality of striking force receiving surfaces 6*b*.

Therefore, if the striking force is the same, a load received by the individual striking force transmitting surfaces 7*b* and the individual striking force receiving surfaces 6*b* can be alleviated, and the wear of the striking force transmitting surfaces 7*b* and the striking force receiving surfaces 6*b* can be suppressed. Therefore, the life of the ring bit 2 and the life of the pilot bit 3 can be extended.

In addition, even when a strong striking force is exerted to the pilot bit 3, the striking force can be efficiently transmitted to the ring bit 2 since a large total abutting area of the striking force receiving surfaces 6*b* of the ring bit 2 and the striking force transmitting surfaces 7*b* of the pilot bit 3 can be secured.

In the embodiment, the striking force transmitting surfaces 7*b* and the striking force receiving surfaces 6*b* are inclined to the posterior end side in the axis O direction as it goes to the outer circumferential side with respect to the axis O. For this reason, an even larger total abutting area of the striking force transmitting surfaces 7*b* and the striking force receiving surfaces 6*b* can be secured, and a striking force can be more reliably distributed and transmitted. In addition, wear can be more reliably prevented as well.

However, in a case where the striking force transmitting surfaces 7*b* and the striking force receiving surfaces 6*b* are inclined to the posterior end side in the axis O direction as it goes to the outer circumferential side in such a manner, a sufficiently large total abutting area cannot be secured if the inclination angles θ with respect to the axis O are excessively large, and the striking force transmitting surfaces 7*b* dig into the striking force receiving surfaces 6*b* if the inclination angles θ are excessively small. Therefore, there is a possibility that collecting the pilot bit 3 becomes difficult after drilling is terminated as described above. For this reason, it is desirable that the inclination angles θ of the striking force transmitting surfaces 7*b* and the striking force receiving surfaces 6*b* with respect to the axis O be within a range of 40° to 80° as in the embodiment.

In the embodiment, as for the two first and second projections 7A and 7B, which are adjacent to each other in the axis O direction, the length of the first projection 7A, which is on the tip end side in the axis O direction, in the circumferential direction is smaller than the length of the second projection 7B, which is on the posterior end side in the axis O direction, in the circumferential direction. In conjunction with this, the length of a portion of the recessed trench 5, in which the first projection 7A is inserted, in the circumferential direction (distance between the first projecting portions 2D adjacent to each other in the circumferential direction) is smaller than the length of a portion of the recessed trench 5, in which the second projection 7B is inserted, in the circumferential direction (distance between the second projecting portions 2E adjacent to each other in the circumferential direction).

Therefore, the pilot bit 3 cannot come off to the tip end side more than a state where the second projection 7B is disposed at the position of the second housing trench 6B in the axis O direction. Therefore, when inserting or pulling the pilot bit 3 into or out from the inner circumferential part of the ring bit 2, or when the pilot bit 3 is rotated to the opposite side to the rotation direction T in drilling and the sediment is discharged in a case where the recessed trenches 5 are clogged with sediment in a state where the first and second projections 7A and 7B are housed in the first housing trench 6A and the second housing trench 6B in drilling, it is possible to prevent the occurrence of a situation in which the pilot bit 3 comes off to the tip end side and falls inside the borehole and to reliably collect the pilot bit 3.

Although the two striking force receiving surfaces 6*b* are formed in the ring bit 2 and abut the striking force transmitting surfaces 7*b* formed in the two second and third projections 7B and 7C of the pilot bit 3 respectively in the embodiment, it is also possible to transmit a striking force by forming three or more striking force receiving surfaces 6*b* and three or more striking force transmitting surfaces 7*b*, which can abut one another, in the ring bit 2 and the pilot bit 3 respectively.

In addition, although the recessed trenches 5 are open to the tip surface of the ring bit 2 in the embodiment, the recessed trenches 5 may be open at least to the posterior end side of the inner circumferential part of the ring bit 2 such that the pilot bit 3 can be collected, or the first housing trench 6A and the first projection 7A may be formed in the ring bit 2 and the pilot bit 3, for example, without the recessed trenches 5 being open to the tip surface of the ring bit 2. In this case, for example, the second housing trench 6B is set as a "stop trench" which is occluded on the rotation direction T side, and the trench wall facing the opposite side to the rotation direction T is set as the torque receiving surface 6*a*. The wall surface of the second projection 7B, which faces the rotation direction T, abuts the torque receiving surface 6*a* as the torque transmitting surface 7*a* and thus torque may be transmitted.

INDUSTRIAL APPLICABILITY

The drilling tool of the present invention can prevent the concentration of a striking force to suppress early wear of the pilot bit and the ring bit and can reliably transmit a striking force to the ring bit even when a large striking force is exerted to the pilot bit. Thus, the drilling tool can be used for industrial purposes.

REFERENCE SIGNS LIST

1: casing pipe
1A: casing top
1B: engagement trench
2: ring bit
2C: posterior end portion of ring bit 2
2D: first projecting portion of ring bit 2
2E: second projecting portion of ring bit 2
2F: third projecting portion of ring bit 2
3: pilot bit
4: drilling tip
5: recessed trench
6: housing trench
6A: first housing trench
6B: second housing trench

6*a*: torque receiving surface
6*b*: striking force receiving surface
7A: first projection of pilot bit 3
7B: second projection of pilot bit 3
7C: third projection of pilot bit 3
7*a*: torque transmitting surface
7*b*: striking force transmitting surface
O: axis of casing pipe 1
T: rotation direction of pilot bit 3 in drilling
θ: inclination angles of striking force transmitting surface 7*b* and striking force receiving surface 6*b* with respect to axis O

The invention claimed is:

1. A drilling tool comprising:

a casing pipe having a circular tubular shape about an axis;

a cylindrical or annular ring bit which is rotatably fitted to a tip portion of the casing pipe; and a pilot bit which is inserted into an inner circumferential part of the ring bit and configured to receive an axial striking force exerted to toward a tip end side of the pilot bit while the pilot bit is being rotated about the axis, wherein the ring bit is engaged with and fitted to the casing pipe on the tip end side in the axial direction, a plurality of projections are formed along the axial direction on an outer circumferential portion of the pilot bit with an interval therebetween, with a first projection toward the tip end side of the pilot bit, a third projection toward a posterior side of the pilot bit, and a second projection between the first and third projections in one line along the axial direction, a recessed trench, which is configured for at least the first and second projections to be inserted from a posterior end side in the axial direction and extends in the axial direction, and first and second housing trenchs, which extend from the recessed trench in a rotation direction of the pilot bit in drilling and are configured to respectively house at least the first and second projections, are formed in the inner circumferential part of the ring bit, a torque transmitting surface, which is configured to face the rotation direction, is formed in the at the first projection or the second projection, a torque receiving surface, which is configured to face an opposite side to the rotation direction and is capable of abutting the torque transmitting surface, is formed in the first housing trench or the second housing trench, striking force transmitting surfaces, which are configured to face the tip end side in the axial direction, are formed in at least the second and third projections among the plurality of protrusions, in the axial direction with an interval therebetween, and two or more striking force receiving surfaces, which are configured to face the posterior end side in the axial direction and are capable of abutting the striking force transmitting surfaces respectively, with a first striking force receiving surface formed in the second trench of the ring bit capable of abutting the striking force transmitting surface of the second projection and a second striking force receiving surface formed in the posterior end side of the ring bit capable of abutting the striking force transmitting surface of the third projection with an interval equal to the interval of the striking force transmitting surfaces in the axial direction.

2. The drilling tool according to claim 1, wherein the striking force transmitting surfaces and the striking force receiving surfaces are inclined to the posterior end side in the axial direction as being extended toward an outer circumferential side with respect to the axis.

3. The drilling tool according to claim 2, wherein, in two protrusions adjacent to each other in the axial direction among the protrusions, a length of one protrusion in a circumferential direction is shorter than a length of other protrusion in the circumferential direction, the one protrusion being one of two protrusions on the tip end side in the axial direction and the other protrusion being other of two protrusion on the posterior side in the axial direction.

4. The drilling tool according to claim 1, wherein, in two protrusions adjacent to each other in the axial direction among the protrusions, a length of one protrusion in a circumferential direction is shorter than a length of other protrusion in the circumferential direction, the one protrusion being one of two protrusions on the tip end side in the axial direction and the other protrusion being other of two protrusion on the posterior side in the axial direction.

* * * * *